United States Patent [19]

Wistrand et al.

[11] Patent Number: 5,076,299

[45] Date of Patent: Dec. 31, 1991

[54] FLEXIBLE LOCKING HAIR CURLER

[75] Inventors: John C. Wistrand, New Canaan; Vito Carlucci, Stratford, both of Conn.

[73] Assignee: Clairol Incorporated, New York, N.Y.

[21] Appl. No.: 341,885

[22] Filed: Apr. 24, 1989

[51] Int. Cl.[5] ..... A45D 2/18

[52] U.S. Cl. ..... 132/253; 132/245; 132/247; 132/254

[58] Field of Search ..... 132/222, 223, 226, 229, 132/233, 245, 247, 250, 253, 254, 265

[56] References Cited

U.S. PATENT DOCUMENTS

| | | | |
|---|---|---|---|
| 404,501 | 6/1889 | Pfanne | 132/253 |
| 2,452,225 | 10/1948 | Coloccia | 132/247 |
| 2,555,933 | 6/1951 | Renstrom | 132/247 |
| 2,623,530 | 12/1952 | Solomon | 132/253 |
| 2,713,864 | 7/1955 | Solomon | 132/253 |
| 3,257,541 | 6/1966 | Jorgensen | 132/229 |
| 3,483,876 | 12/1969 | Planel | 132/229 |
| 4,236,540 | 12/1980 | Takagi et al. | 132/233 |
| 4,579,132 | 4/1986 | Thaler | 132/226 |

FOREIGN PATENT DOCUMENTS

| | | | |
|---|---|---|---|
| 247539 | 10/1963 | Australia | 132/252 |
| 979883 | 5/1951 | France | 132/253 |
| 313889 | 5/1956 | Japan . | |

*Primary Examiner*—John J. Wilson
*Assistant Examiner*—Frank A. LaViola
*Attorney, Agent, or Firm*—Gene Warzecha; Anthony M. Santini

[57] ABSTRACT

A bobbin or spool type hair curler having a cylindrical hair roller portion formed between a pair of opposing parallel flanges and provided with a pliable, integrally formed, cup-shaped closure member. The closure member is axially aligned to one of the end flanges of the spool shaped hair roller portion. The wall of the cup-shaped closure member extends away from the spool shaped portion and, after the hair is wound upon the spool shaped portion, the wall may be flipped substantially 180° about its point of attachment to its corresponding flange in order to place the rim of the cup-shaped closure member proximate to the other flange to thereby retain the hair around the spool shaped portion. The invention additionally includes a method for curling hair with the aforementioned device and, in one embodiment the hair curler is provided with an axial throughbore and the invention further includes a method for heating same.

17 Claims, 6 Drawing Sheets

FLEXIBLE LOCKING HAIR CURLER

BACKGROUND OF THE INVENTION

1. FIELD OF THE INVENTION

The invention relates generally to personal care devices for grooming hair. More particularly, the invention relates to hair curlers.

DESCRIPTION OF THE PRIOR ART

Hair curling devices are widely used and are available in numerous embodiments. The term "devices" as used herein refers to non-energized, passive articles and is distinguishable from "appliances" which may be used to refer to energized, active apparatus requiring some power input for proper operation. Appliances may, for example, produce heat, radiation, air flow, fan movement, etc. Hair curlers in particular are devices which may be formed in a wide variety of shapes and configurations, all generally intended to have a tress of hair wound and retained thereupon for a predetermined time, with or without heat and with or without hair treating solutions, in order to set a particular curl shape in the tress of hair.

Hair curlers generally comprise a hair rolling portion, and a closure member for retaining the hair upon the hair rolling portion. The latter is usually a generally cylindrical member constituting a core or mandrel about which the hair is wound, this member having a predetermined cross-section and bounded by end flanges having a greater diameter than the core. Most often the closure member is a piece that is separate from the hair curler such as a clip, "bobby" pin, etc. which must be attached to the curler in a way to retain hair wound upon the mandrel. Hair curlers with separate closure members are somewhat difficult to use on one's own hair because the user must use her hands to wind the hair on the hair rolling portion, hold it there with one hand while grasping a clip, for example, with the other hand, and then maneuver the clip (often without looking) to lock the hair in place. Another disadvantage of separate closure members is that they generally must be made hard and relatively inflexible in order to satisfactorily hold hair and this may make them uncomfortable to the user.

Some hair curlers may have closure members affixed to the hair rolling portion. Such members are really separate pieces that are mechanically hinged or otherwise movably joined with the hair rolling portion. These devices still remain uncomfortable, awkward to use and, additionally, are more costly to manufacture.

Accordingly, it is an object of this invention to provide a hair curler having a hair rolling portion integrally and inseparably formed with a closure member.

It is another object of this invention to provide a hair curler wherein the hair rolling portion and the closure member are formed of the same relatively soft material such as, for example, a viscoelastic polymer.

It is yet another object of this invention to provide a hair curler having a hair rolling portion integrally formed with the closure member while simultaneously providing a hair curler capable of being heated and retaining heat for a sufficient time to curl hair.

It is still a further object of this invention to provide a new method for curling hair, the method comprising winding the hair upon a spool shaped hair rolling portion having an integrally formed closure member, then folding the closure member axially relative to the spool member to retain the hair wound thereupon.

SUMMARY OF THE INVENTION

These and other objects are achieved by the preferred embodiment of the invention which is an improved hair curler comprising: a spool shaped body comprising a cylindrical shaft portion, a first flange integrally connected to said shaft portion at one end thereof and a second flange integrally connected to said shaft portion at the other end thereof; a cup-shaped closure member attached to and extending from said second flange, said cup-shaped closure member adapted to be placed in either one of two positions, i.e. an open position in which the rim of said cup-shaped closure member is distal from said first flange and a closed position in which the rim of said cup-shaped closure member is proximate to said first flange, said curler thereby capable of retaining hair between said shaft portion and said cup-shaped closure member when the latter is in said closed position, said hair being retained between said first flange and said rim.

In another embodiment, the aforementioned rim of said cup-shaped closure member is secured to said second flange by a plurality of circumferentially spaced, longitudinally extending strap members each having a predetermined length and having apertures therebetween.

In yet another embodiment, the aforementioned strap members are alternated circumferentially with a plurality of short locking tabs depending from the rim. In the closed position these locking tabs aid in retaining hair wound upon the curler.

The invention also includes a new method for curling hair, the method comprising the steps of: winding a predetermined amount of hair onto a spool member having a first flange, a second flange and a pliable, cup-shaped closure member the wall of which extends from said second flange, in a direction away from said first flange, and terminates in a rim at an open end; and moving the wall of said cup-shaped closure member substantially 180° relative to said second flange to place the rim of said cup-shaped closure member proximate said first flange and thereby retain the hair on said spool member.

The invention also includes a new method for heating spool shaped hair curlers comprising the steps of: providing a heatable spool shaped hair curler with an axially aligned bore therethrough; placing at least one axially bored spool shaped, heatable hair curler onto a heatable post by threading the latter through the axial bore of said spool shaped hair curler, said post having a predetermined length sufficient to extend substantially through said axial bore and a predetermined diameter substantially equal to the inside diameter of said axial bore; and heating said heatable post to a predetermined temperature.

DESCRIPTION OF THE PREFERRED EMBODIMENT

Figure 1:
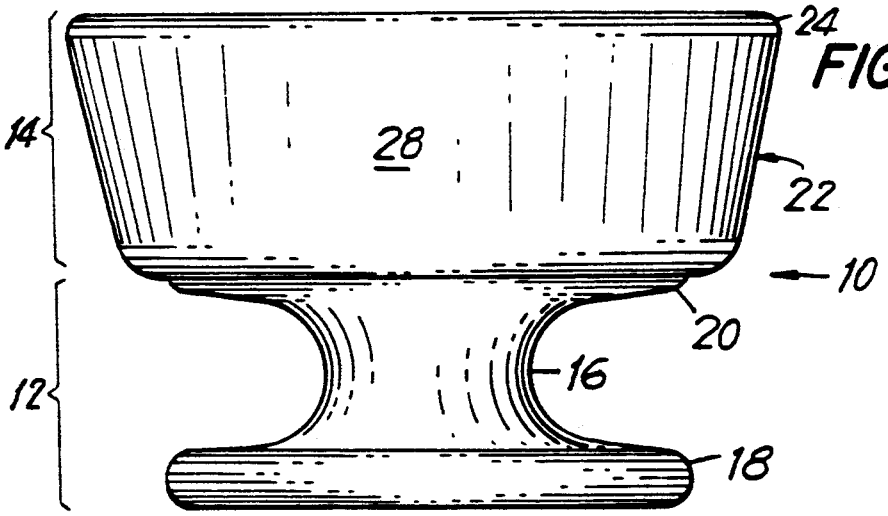
FIG. 1 is a side elevational view of a hair curler constructed in accordance with the principles of this invention.

Referring now to FIG. 1 there is shown a side elevational view of an improved hair curler 10 constructed in accordance with the principles of this invention. Hair curler 10 comprises a bobbin or spool shaped hair roller portion 12 and a cup-shaped hair closure member or clasping portion 14 integrally attached thereto. Closure means 14 comprises a generally open cup-shaped structure axially aligned with hair roller portion 12 and having a generally cylindrical wall 22, rim 24, inside surface 26 and outside surface 28. The lower annular edge of cylindrical member 22 is integrally joined to flange 20 along an annular joining portion 30. (A similar effect is achieved if the cup-shaped closure means 14 is considered to comprise a bottom surface abutting the outer surface of flange 20.) As will be understood below, hair to be curled with hair curler 10 is wound upon the shaft portion 16 between flanges 18 and 20 and is retained in hair roller portion 12 by closure means 14. Flange 18 because it does not have any associated cup-shaped closure member is occasionally referred to herein as a free flange. Shaft portion 16 may be of any desired cross-section although the drawings show embodiments having circular cross-sections.

Figure 5:
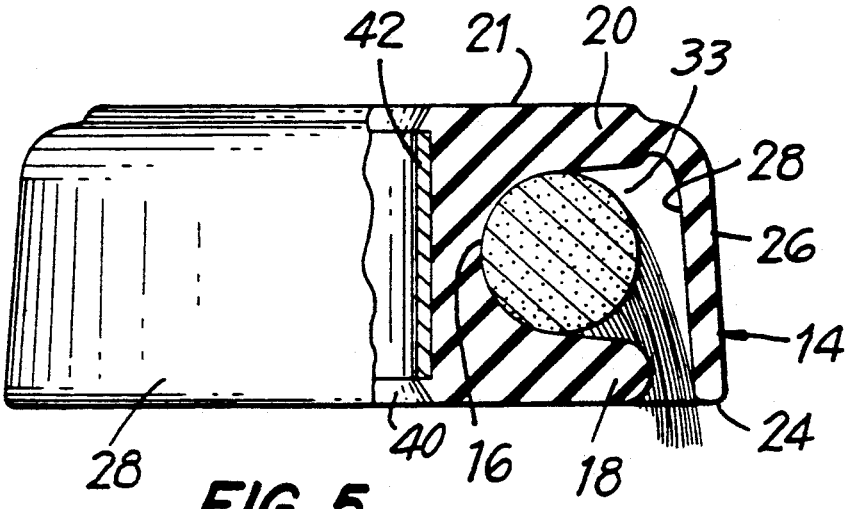
FIG. 5 is a side elevational view, partly in cross-section, of the embodiment of FIG. 2 shown in closed configuration about a tress of hair.

In the preferred embodiment, the entire hair curler 10 is formed from a pliable, elastomeric type of material. The material is capable of being heated (by an appliance means shown in FIG. 13) and of retaining a sufficient amount of heat for a time sufficient to curl hair. The material from which the curler is made is sufficiently pliable to enable the cup-shaped closure means 14 to be flipped between two positions about annular portion 30 substantially 180° relative to the surface of flange 20 (i.e. relative to a normal to axis 32): an open, unlocked position as shown in FIGS. 1–4, with rim 24 distal from flange 18, and a closed, locked position as shown in FIG. 5. Hair may be wound upon the hair roller portion when the closure means is in the open position. When in the locked position, outer surface 28 of the closure portion faces inwardly and rim 24 is placed proximate to flange 18 thereby retaining any hair wound upon shaft portion 16 within the space 33 bounded by shaft 16, flanges 18 and 20 and closure wall 28. The hair near the roots is not enclosed in space 33 and is able to, because of the pliability of rim 24 (and, to some extent, because of the flexibility of the hair) extend from space 33 between rim 24 and flange 18. Depending on the amount of hair wound about shaft 16, rim 24 may be at, above or below the level of flange 18 and may be at various radial distances therefrom. Flange 20 has a top surface 21 which in the open, unlocked configuration of the curler forms the bottom of cup-shaped closure portion 14 and, in the closed, locked configuration forms one outer side as shown in FIG. 5.

Figure 2:
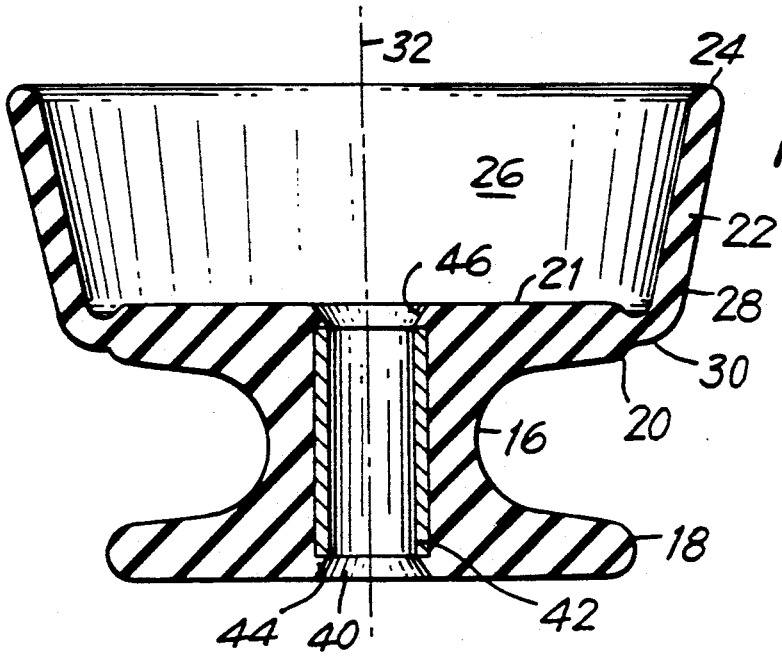
FIG. 2 is a cross-sectional view of FIG. 1.
Figure 3:
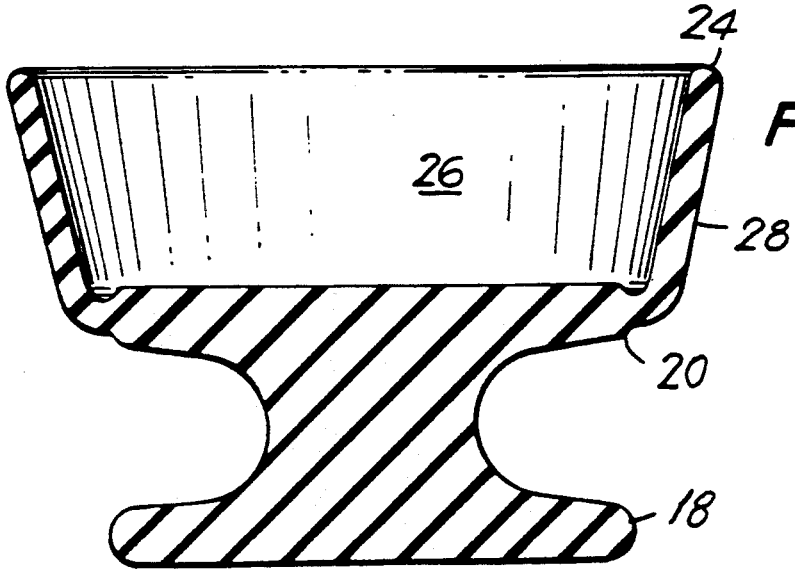
FIG. 3 is a cross-sectional view of an alternative embodiment of the hair curler of FIG. 1.
Figure 4:
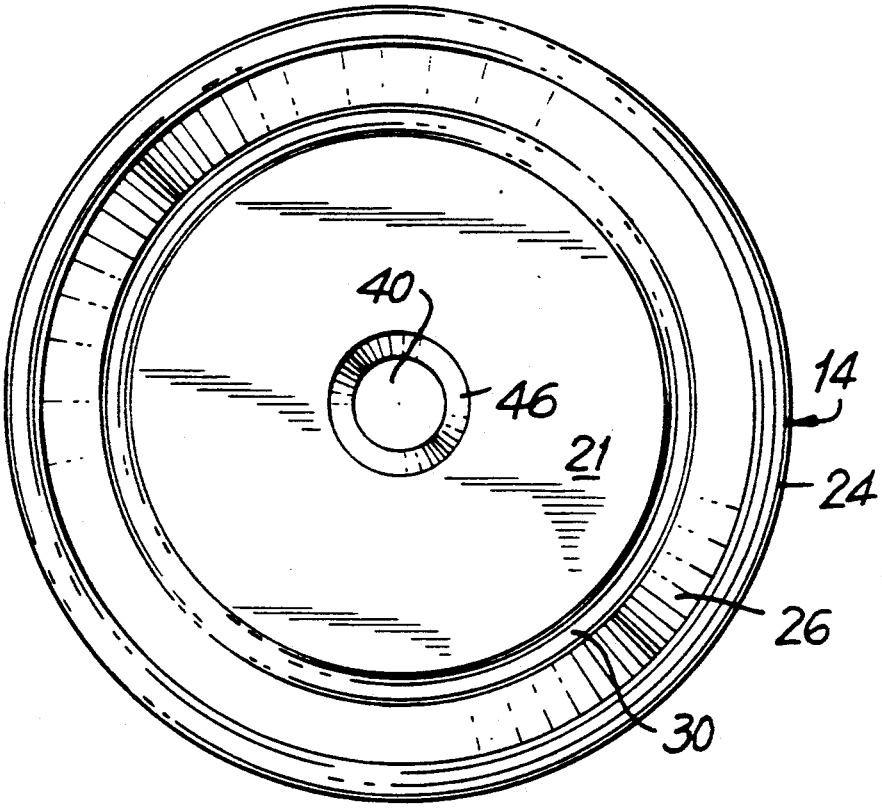
FIG. 4 is a top plan view of the hair curler shown in FIGS. 1 and 2.

Hair curler 10 may be constructed with an axial bore 40 as shown in FIG. 2 or without such bore as shown in FIG. 3. In the embodiment shown in FIG. 2, axial bore 40 contains a hollow cylindrical shaft or core member 42, the ends of which may be recessed slightly from the outer surfaces of flanges 18 and 20 as shown. Flanges 18 and 20 may have annular projections 44 and 46, respectively, extending into hollow portion 40 in order to retain the shaft. Shaft 42 may be formed from metal or other good heat retaining material and with a variety of cross-sectional shapes (not shown), and may be used to facilitate heating curler 10 prior to its application to the hair (in accordance with a method described below).

The relative dimensions of the parts of curler 10 may be varied provided the curler can still operate as described above. For example, shaft 16 may be longer or shorter than shown in the various Figures and the height of wall 22 may be correspondingly increased or decreased. The radial difference between the outermost points of flanges 18 and 20 and the surface of shaft 16 may be changed to accommodate a greater or lesser amount of hair, and the size of cup-shaped member 14 may be adjusted. Also, the radii of flanges 18 and 20 need not be identical.

Figure 6:
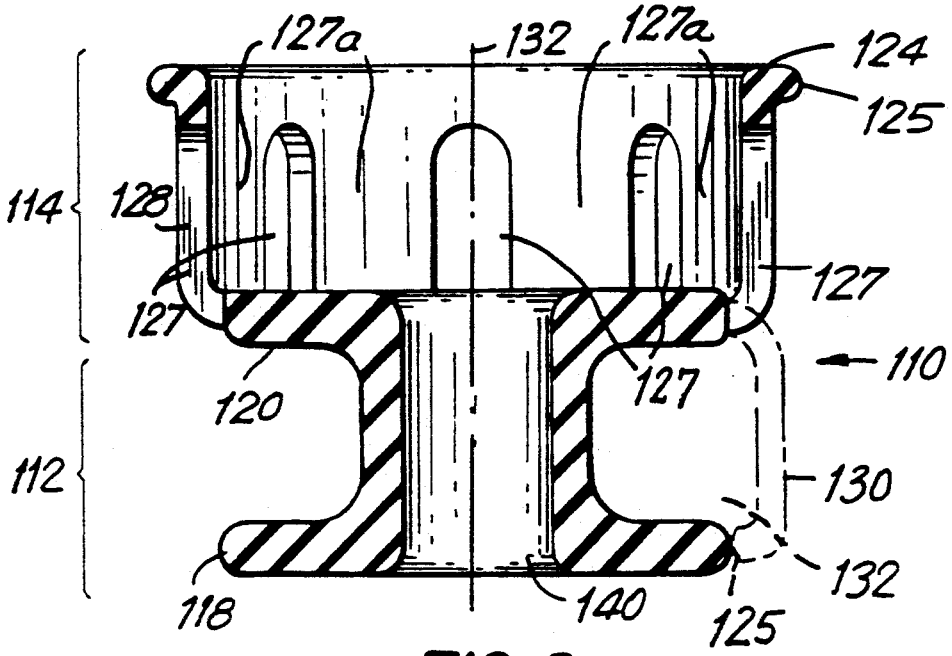
FIG. 6 is a cross-sectional, elevational view of an alternative embodiment of the invention.
Figure 7:
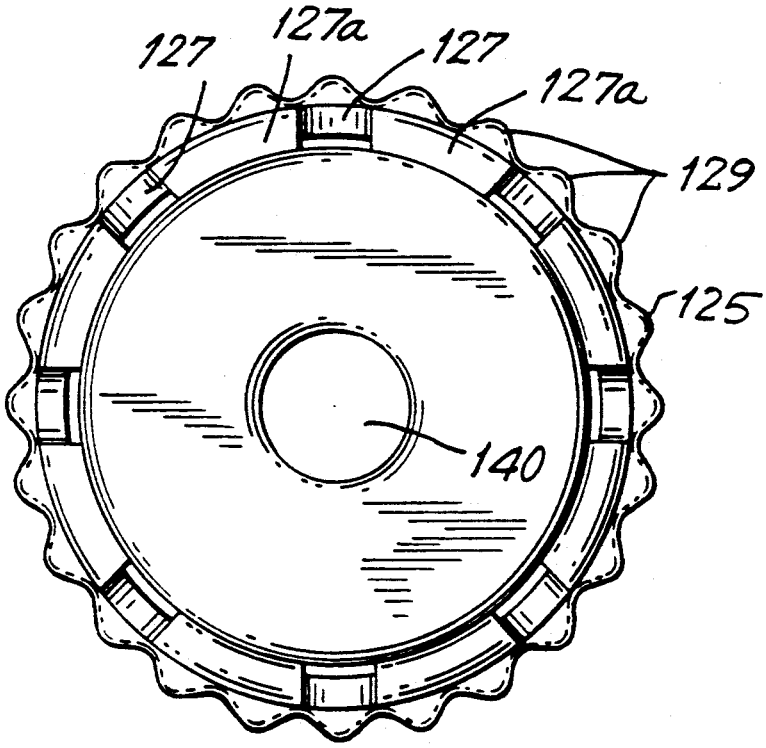
FIG. 7 is a plan view of FIG. 6.
Figure 8:
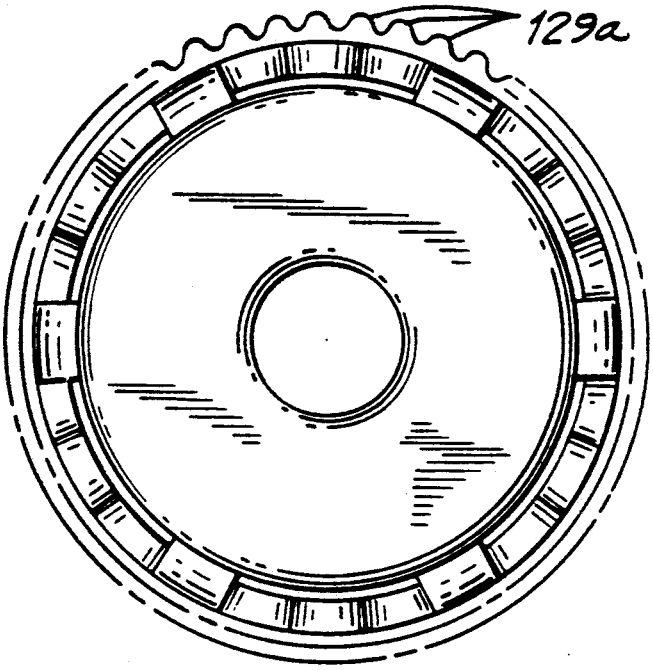
FIG. 8 is a plan view of alternative embodiment of the hair curler shown in FIG. 7.

An alternative embodiment of the invention is shown in FIG. 6 as roller 110 comprising cup-shaped closure portion 114 and spool shaped hair roller portion 112. Flanges 118 and 120 and bore 140 are similar to parts 18, 20 and 40, respectively, in FIG. 2. Closure portion 114 is provided with a rim 124 having a radially outwardly extending flange 125 and attached to flange 120 by wall 128 which is formed of a plurality of longitudinally extending, circumferentially spaced apertures 127 interposed between a plurality of strap members 127*a*. Apertures 127 extend perpendicularly from, and a predetermined distance below, rim 124 to the top of flange 120 to which wall 128 is connected in order to enable wall 128 to be properly positioned adjacent the bottom flange in a closed position. Part of closure portion 114 is shown in phantom at 130 to show the approximate appearance of curler 110 in a closed position (without hair). It should be understood that in an actual curler, wall 128 would be annularly situated relative to flange 118 in a closed position. As shown in FIG. 7, flange 125 is provided with a plurality of annularly spaced longitudinally extending ribs 129 in order to enhance the gripping action between the roller 110 and the hair wound thereupon. As shown in FIG. 8, the ribs may be made as smaller ribs 129*a*. Alternatively, the outer surface of flange 125 may be provided with a knurled surface (not shown) or other irregular surface means to enhance gripping action.

Wall 128 of roller 110, being provided with apertures 127, enables rim 124 and flange 125 to be positioned closer to the bottom, free flange of the roller when it is in closed position 130. The natural elasticity of the material in wall 128 which would normally tend to exert a radially outward force on the rim in a closed position is, by virtue of the apertures, decreased somewhat, thus preventing the material in the wall form pushing the rim away excessively. It will be understood that the resulting normally tight fit between flange 125 and free flange 118 (although they do not necessarily tough as shown in FIG. 6) enhances the gripping of the hair. The outwardly extending nature of flange 125 (best seen in FIG. 6) further decreases the gap between flange 118 and rim 124, thus enhancing the gripping action on hair wound upon the roller. Additionally, apertures 127 permit air flow into the interior 132 of the closed roller by either natural means or artificial means such as a hair dryer, etc.

The wall of the closure member may be parallel to the axis of the hair curler, as shown by wall 128 relative to axis 132 in the embodiment of FIG. 6, or may be tilted radially outwardly relative to the axis, as shown by wall 28 relative to axis 32 in the embodiment of FIG. 1. It will be understood that the wall of the closure member could be tilted radially inwardly in the open position. This would require the rim to be radially stretched (over the flange to which it is attached) as the closure member is placed into the locked position and would result in the rim having a tighter grip on the hair against the free flange.

Figure 9:
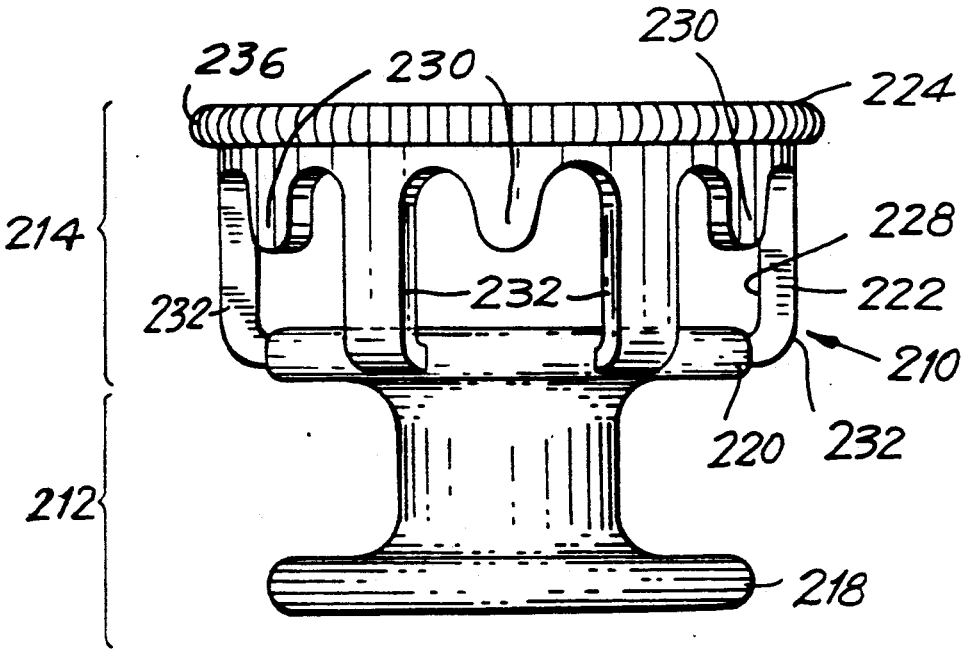
FIG. 9 is a side elevational view of another alternative embodiment of a hair curler constructed in accordance with the principles of this invention.
Figure 10:
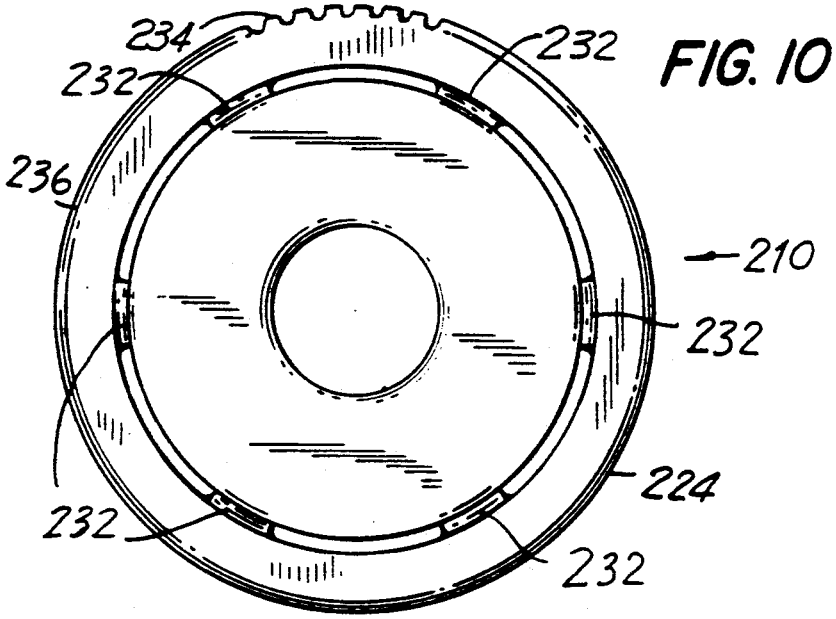
FIG. 10 is a top plan view of FIG. 9.
Figure 11:
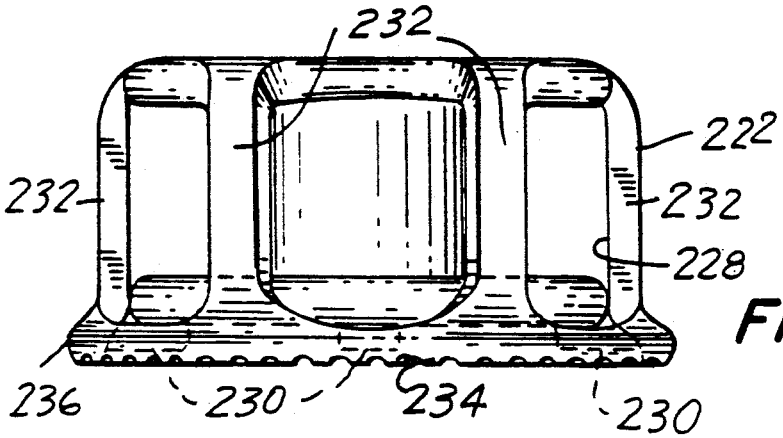
FIG. 11 is a side elevational view of the embodiment of FIG. 9 shown in a closed position, without hair.
Figure 12:
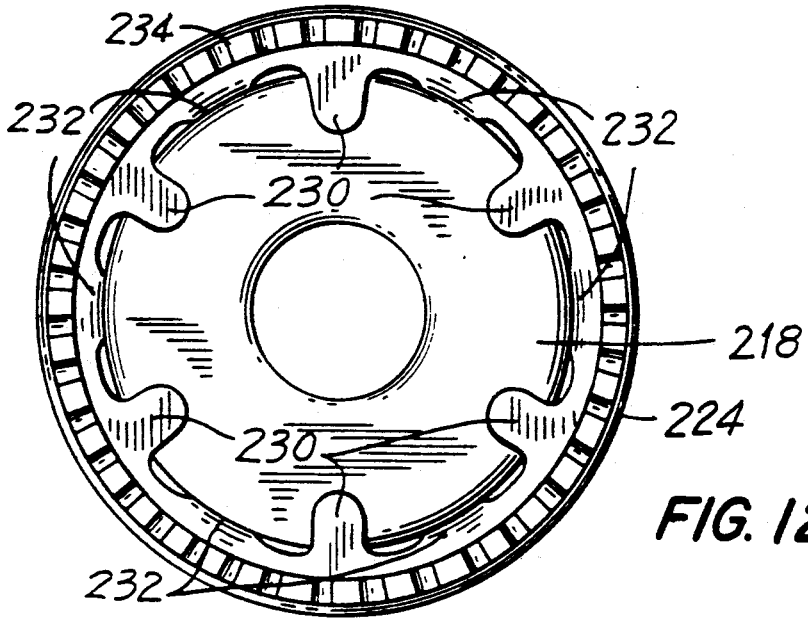
FIG. 12 is a bottom plan view of FIG. 11.

Yet another alternative embodiment of the invention is shown in FIGS. 9–12 in the form of hair curler 210. The primary difference between this and the previous embodiments lies in the structure of wall 222 which comprises a plurality of circumferentially spaced locking tabs 230 alternatively interspersed between strap members 232. As shown in FIG. 9, tabs 230 extend substantially perpendicularly downwardly from rim 224 but do not reach flange 220. While tabs 230 are substantially parallel to strap members 232 when the curler is in the open position (FIG. 9), tabs 230 tend to lie on the surface of flange 218 in the closed position (FIG. 12), thereby creating tension between rim 224 and flange 218. It will be understood that this tension is due to the interlocking or interdigitating cooperative action between tabs 230 and flange 218. In this embodiment, the various projections 234 in the outwardly directed flange 236 of rim 224 do not have as great a locking effect as tabs 230. While all of the tabs are shown lying on flange 218, in practice some tabs will be as shown while others may curl inwardly pointing toward the interior of the closed curler.

Figure 13:
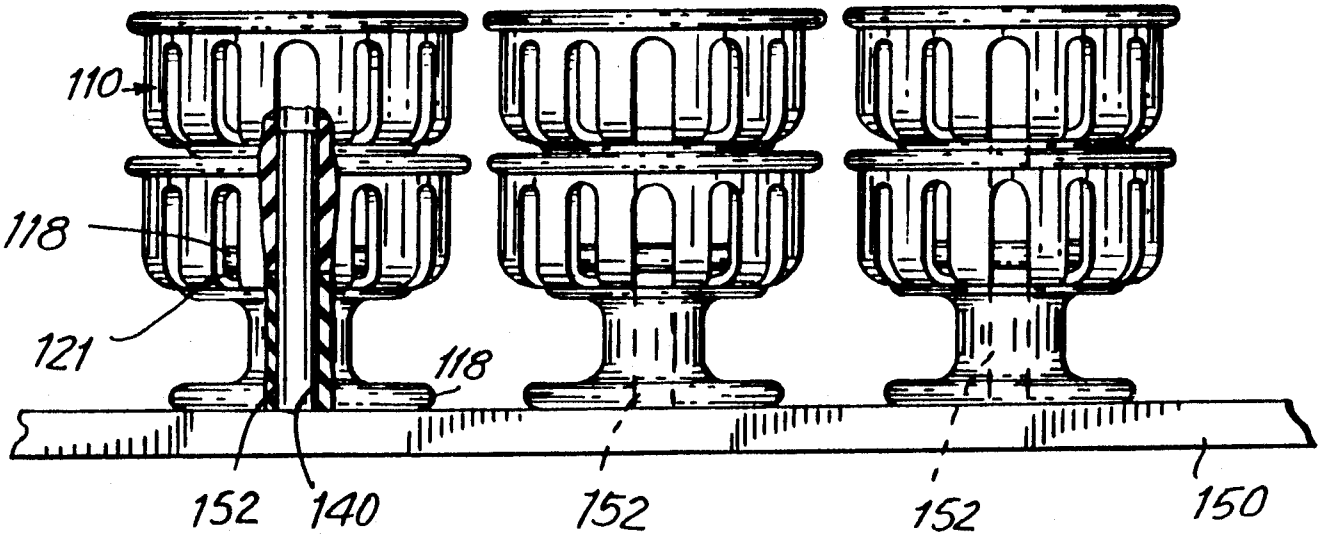
FIG. 13 is a schematic side elevational view of an embodiment of an apparatus for heating a hair curler constructed in accordance with the principles of this invention.

The various embodiments of spool shaped hair curlers of the present invention may be heated pursuant to a new method made possible by the present invention. The embodiment of FIG. 6 is shown in FIG. 13 in order to explain the operation of the new method. A plurality of spool shaped hair curlers may be heated easily by virtue of bores 140 which, as best seen in FIG. 13 enable curlers 110 to be stacked on a heating base 150. The latter is shown schematically and may be any suitable heating means for supporting and heating a plurality of heat-conducting posts 152 extending vertically from base 150. Curlers 110 are stacked on posts 152 as shown, with the free flange 118 of each top curler abutting surface 121 of the adjacent bottom curler. This type of nesting arrangement minimizes the post length required for a given number of curlers. Posts 152 may be arranged on base 150 in any desirable pattern and the entire assembly may be covered by a cover (not shown) to retain heat around the curlers in the manner of a conventional hairsetter.

Posts 152 have a diameter and cross-section substantially equal to the inside diameter and cross-section of bores 140 in order to enhance heat conductivity. While the embodiment in FIG. 13 only shows a stack two-high, it will be understood that any number of curlers may be stacked on each post. Obviously, the length of posts 150 must be increased accordingly and should extend from base 150, through the bore of the lower curler and through the bore of the top and intermediate curlers. To optimize heat transfer from the posts to the curlers, the posts should extend substantially if not entirely through the bore of the top curler.

It will be understood by those skilled in the art that numerous other modifications and improvements ma be made to the preferred embodiment of the invention disclosed herein without departing from the spirit and scope thereof.

What is claimed is:

1. A hair curler comprising:

a spool-shaped body comprising a cylindrical shaft portion, a first flange integrally connected to said shaft portion at one end thereof, and a second flange integrally connected to said shaft portion at the other end thereof;

a cup-shaped closure member having a rim and being attached to and extending from said second flange, the rim of said cup-shaped closure member being secured to said second flange by a plurality of circumferentially spaced strap members, said cup-shaped closure member adapted to be placed in one of two positions, said two positions consisting of an open position in which the rim of said closure member is distal from said first flange, and a closed position in which the rim of said closure member is proximate to said first flange; and means interposed between said strap members for releasably fastening said rim to said first flange when said closure member is in said closed position.

2. A hair curler according to claim 1 wherein said strap members extend substantially perpendicular to said rim when said cup-shaped closure member is in said open position.

3. A hair curler according to claim 1 wherein said means and said strap members are alternatingly situated about the rim of said cup-shaped closure member.

4. A hair curler according to claim 1 wherein said first and second flanges are each circular and of equal diameter.

5. A hair curler according to claim 1 wherein said first flange and the open end of said cup-shaped closure member are circular and wherein said open end has, in said open position, a diameter greater than or equal to that of said first flange.

6. A hair curler according to claim 1 wherein said spool shaped body and said cup-shaped closure member are integrally formed of a pliable material.

7. A hair curler according to claim 1 wherein said rim is further provided, when viewed in an open position, with a radially outwardly extending annular flange.

8. The hair curler of 7 wherein said annular flange is provided with an irregular surface means at its most radially outward surface for engaging hair wound upon said curler to maintain said curler in engagement with said wound hair when said closure member is in said closed position.

9. A hair curler according to claim 1 wherein said spool shaped body is provided with an axial bore.

10. A hair curler according to claim 9 wherein said bore extends through said spool shaped body and further comprising a hollow core member extending through said axial bore, said core member having a length less than or equal to the distance between the outer surfaces of said first and second flanges.

11. The hair curler of claim 1 wherein said means comprises a plurality of circumferentially spaced locking tabs, each locking tab extending substantially parallel to said strap members when said closure member is in said open position, and each having a predetermined length and being attached at one end thereof to the rim of said closure member, the other end of each locking tab being unattached.

12. The hair curler of claim 1 further comprising interdigitating means associated with at least one of said rim or said first flange for engaging hair wound upon said curler to maintain said curler in engagement with said wound hair.

13. A hair curler comprising:

a spool-shaped body having a flange integrally connected to each end thereof;

an open-ended closure member attached to and extending from one of said flanges, said closure member comprising an annular rim member lying generally in a plain parallel to and spaced from the flange to which it is attached and joined thereto by a plurality of peripherally spaced pliable straps, said closure member adapted to be folded over to enclose hair wound upon said spool-shaped body;

and means interposed between said strap members for releasably fastening said rim to the flange to which the closure member is not attached, when said closure member is in a folded position.

14. A hair curler according to claim 13 wherein said means comprises:

a plurality of peripherally spaced locking tabs, each locking tab attached at one end thereof to said rim and depending therefrom when said closure member is in an unfolded position, each locking tab having a predetermined length and the other end of each locking tab being unattached.

15. A method of heating spool shaped hair curlers comprising the steps of:

providing a plurality of heatable, spool shaped hair curlers, each having an axially aligned bore therethrough and comprising a first flange, a second flange and a pliable cup-shaped closure member the wall of which extends from said second flange;

placing at least one of said heatable, spool shaped hair curlers onto a heatable post by threading the latter through the axial bore of said spool shaped hair curler, said post having a predetermined length sufficient to extend substantially through said axial bore and a predetermined diameter substantially equal to the inside diameter of said axial bore;

placing another of said spool shaped heatable hair curlers onto the same heatable post in a nesting manner such that the first flange of one spool shaped hair curler is contiguous to the bottom of the cup-shaped closure member of the adjacent spool shaped hair curler; and heating said heatable post to a predetermined temperature.

16. A method of heating spool shaped hair curlers comprising the steps of:

providing a plurality of heatable, spool shaped hair curlers, each having an axially aligned bore completely therethrough and a pliable cup-shaped closure member extending from one end thereof;

placing a plurality of said heatable, spool shaped hair curlers onto a heatable post in a nesting manner such that the bottom of the cup-shaped closure member of one spool shaped hair curler is contiguous to the other end of the adjacent spool shaped hair curler; and heating said heatable post to a predetermined temperature.

17. A method of heating spool shaped hair curlers comprising the steps of:

providing a heatable spool shaped hair curler with an axially aligned bore completely therethrough, said spool shaped hair curler comprising a first flange, a second flange and a pliable cup-shaped closure member the wall of which extends from said second flange;

placing at least one axially bored spool shaped, heatable hair curler onto a heatable post by threading the latter through the axial bore of said spool shaped hair curler, said post having a predetermined length sufficient to extend substantially through said axial bore and a predetermined diameter substantially equal to the inside diameter of said axial bore;

placing another of said axially bored spool shaped heatable hair curlers onto the same heatable post such that the first flange of each spool shaped hair curler is contiguous to the bottom of the cup-shaped closure member of an adjacent spool shaped hair curler; and heating said heatable post to a predetermined temperature.

* * * * *